United States Patent [19]

Wawiluk et al.

[11] Patent Number: 4,980,927

[45] Date of Patent: Jan. 1, 1991

[54] ADHERENT PROTECTIVE COLLARS

[75] Inventors: Alex A. Wawiluk, Lake Elmo; Harold J. Seppala; Arthur L. Fry, both of St. Paul, all of Minn.

[73] Assignee: Minnesota Mining and Manufacturing Company, St. Paul, Minn.

[21] Appl. No.: 285,619

[22] Filed: Dec. 16, 1988

[51] Int. Cl.[5] ..... A41D 27/16

[52] U.S. Cl. ..... 2/60; 2/46; 2/129; 2/132

[58] Field of Search ..... 2/49 R, 49 A, 60, 50, 2/55, 132, 135, 136, 174, 207, 46, 129, 132

[56] References Cited

U.S. PATENT DOCUMENTS

| | | | |
|---|---|---|---|
| 1,723,018 | 8/1929 | Dunlap | 2/60 |
| 3,105,970 | 10/1963 | Herzberg | 2/207 |
| 3,200,413 | 8/1965 | Vaughan | 2/60 |
| 3,260,292 | 7/1966 | Costello | 2/207 X |
| 3,916,447 | 11/1975 | Thompson | 2/46 |
| 3,949,875 | 4/1976 | Cantania et al. | 260/390 |
| 4,008,494 | 2/1977 | Hicks | 2/60 |
| 4,039,711 | 8/1977 | Newman | 428/286 |
| 4,157,719 | 6/1979 | DeWoskin | 604/385.2 |
| 4,176,664 | 12/1979 | Kalish | 604/209 X |
| 4,329,999 | 5/1982 | Phillips | 128/760 |
| 4,429,001 | 1/1984 | Kolpin et al. | 428/283 |
| 4,458,364 | 7/1984 | Fenninger | 2/50 |
| 4,637,411 | 1/1987 | Sanders | 132/9 |
| 4,653,119 | 3/1987 | Kaiser | 2/60 |
| 4,793,003 | 12/1988 | Riedel et al. | 2/15 |

FOREIGN PATENT DOCUMENTS

| | | |
|---|---|---|
| 0287557 | 8/1988 | European Pat. Off. . |
| 1040758 | 10/1958 | Fed. Rep. of Germany . |

*Primary Examiner*—Werner H. Schroeder
*Assistant Examiner*—Jeanette E. Chapman
*Attorney, Agent, or Firm*—Donald M. Sell; Walter N. Kirn; Roger R. Tamte

[57] ABSTRACT

Disposable adherent collars based on low cost supple sheets carrying a low-adherency pressure sensitive adhesive are disclosed. The adherent collars of the present invention are significantly more comfortable to wear than prior art adherent collars due to the suppleness of the sheet used in the collars, and to the low-adherency character of the PSA, achieved preferably through the use of a discontinuous layer of PSA material. Because of the suppleness of the sheet the low-adherency adhesive is effective to hold the sheet in place.

25 Claims, 1 Drawing Sheet

ADHERENT PROTECTIVE COLLARS

BACKGROUND ART

1. Field of the Invention

The present invention relates to disposable, skin-adherent protective collars which can protect a wearer from irritating particulate materials or aqueous fluids.

2. Description of the Related Art

Barbers and beauticians are routinely faced with the problem of providing a means of keeping cut hair or hair treatment fluids from falling down their customers' necks while providing their services. Typical protection consists of a fabric cape, which may have a strip of crepe paper interposed between it and the customer's neck, tightly encircling the customer's neck. The comparatively high profile of the cape frequently results in it directing cut hair or hair treatment fluids into the customer's neck rather than preventing them from doing so Interposing a strip of crepe paper between the cape and the customers neck does little to alleviate the problem as the paper does not reduce the high profile of the cape and further, it is subject to gapping and forming pockets which further aggravates the problem.

An adherent collar having a lower profile than a fabric cape which could be affixed to the customer's neck prior to placement of the cape might have a potential for providing superior protection from particulate or fluid challenges than the conventional creped paper strips. However, previous attempts to provide such collars have, in large part, met with failure, and none is known to be commercial today.

U.S. Pat. No. 1,723,018 to Dunlap describes a collar protector and hair device which comprises a band of fabric adapted to encircle the neck of the user and an adhesive coating adapted to adhere to the flesh of the wearer and to hold the band in position, the adhesive band being limited to a narrow strip along one longitudinal border of the band. Suitable adhesives for the protective collar are said to include those commonly utilized as surgical adhesives.

U.S. Pat. 4,637,411 to Sanders describes a disposable hairdresser's masking sheet of a flexible material for isolating selected strands of a head of hair from other strands of hair while the selected strands are subjected to a coloring agent. The masking sheet comprises a substrate of flexible material configured as two adjacent portions having a common boundary defined by a hinge about which one of the adjacent portions is pivoted relative to the other so as to encapsulate the selected strands of hair and a securing means being carried by the substrate. The securing means described is an adhesive adapted to engage the selected hair strands and the hinged portion of the flexible substrate in a removable manner. The adhesive securing means is displaced inwardly from the edge of the flexible substrate so as to provide a margin free of adhesive which serves as a finger tab to facilitate removal of the sheet.

German Patent No. 1,040,758 describes a collar used to protect the neck of the wearer during a hair cut which comprises a crepe paper strip having a centrally disposed longitudinal stripe of self adhering adhesive. In use, the paper strip is stretched around the wearer's neck and the ends of the adhesive stripe are brought into contact with one another to secure the strip in place without any additional fastening devices.

U.S. Pat. No. 4,458,364 to Fenninger discloses a disposable towel, particularly for hairdressing salons, beauty shops or the like, which is comprised by a support of synthetic material bearing an intermediate layer of defibered cellulose, and a non-woven layer covering the intermediate layer and secured with the layer to the support by gluing, sealing or otherwise. On one side of the cut-out for the neck of the wearer, there are provided tabs for the detachable securement to the other side of the towel. A small pocket for a paper napkin is provided at the upper part of the towel near an edge thereof. Another pocket extends transversely of the midportion of the bottom of the towel to receive cut hair, and has lateral internal compartments for carrying barber's and beautician's implements. This latter pocket may be folded against the support and secured to the latter.

U.S. Pat. No. 3,949,875 to Catania et al discloses a multi-ply strip somewhat longer than the circumference of the average human neck which has two oppositely-facing arcuate edge portions toward the center of the strip to accommodate the contours of the neck In one form, the opposite short ends of the strip have angularly cut-off corner portions to facilitate detachment of the strip from a roll of strips.

U.S. Pat. No. 3,916,447 to Thompson discloses a protective covering having at least one layer of synthetic polymeric microfibers bonded to at least one layer of cellulosic fibers. The exposed microfibers exhibit a tendency to cling to other natural fibers found in clothing or other webs, while the exposed cellulosic fibers present an absorbent surface. The combination is said to be a soft, flexible, aqueous liquid-barrier web useful as a dinner napkin, bib, furniture cover or the like.

SUMMARY OF THE INVENTION

The present invention provides disposable, skin adherent protective collars comprising a soft, conformable barrier sheet, typically a nonwoven fabric, and a layer of low-adherency pressure sensitive adhesive (PSA) disposed along at least one edge of a first face of the barrier sheet. Low adherency, represented by 180°-peel adhesion values to glass of about 5 to 35 grams/2.54 centimeter, not useful for most adhesive functions, has been found adequate to adhere a soft conformable collar around the neck of a wearer, while causing minimal discomfort to the wearer on removal of the collar. Preferably, the PSA layer is discontinuous, i.e., has gaps not filled with PSA, to aid in breathability, and the layer is also preferably topographically structured, by which is meant the PSA layer comprises a pattern of peaks and valleys which limits contact between the PSA and any other substrate, thereby allowing control over the adhesive properties of the collar of the present invention. The adherent protective collars have utility as a means for preventing irritating particulate materials such as cut hair from falling down the wearer's neck.

Some protective collars of the present invention utilize an aqueous-fluid-impermeable sheet material as the barrier sheet. Suitable impervious materials include film/nonwoven web laminates or nonwoven materials which have been treated with fluorochemical or silicone materials to render them impermeable to aqueous fluids. Such protective collars offer the wearer protection from hair treatment fluids such as permanent solutions or hair coloring solutions.

A third embodiment of protective collars of the present invention comprises a laminate structure of an aqueous fluid-absorbent layer, an aqueous-fluid-impermeable layer and a PSA layer. The aqueous-fluid-impermeable layer can consist of a film, a film/nonwoven material laminate or, more preferably, a nonwoven material treated with a fluorochemical or a silicone material to render it impermeable to aqueous fluids.

DETAILED DESCRIPTION OF THE INVENTION

Figure 1:
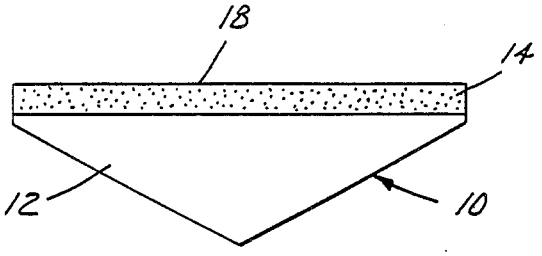
FIG. 1 illustrates an adherent protective collar of the present invention with a band of pressure sensitive adhesive along one edge of the collar.

The disposable adherent protective collars or bands of the present invention utilize soft, conformable sheet materials as a protective barrier as well as a carrier for a low-adherency pressure-sensitive adhesive (PSA) that secures the collar to the skin of the wearer.

A variety of nonwoven fabrics are suitable for use as barrier sheets in the protective collars of the invention. Generally speaking, soft, highly supple fabrics such as those which can be obtained from spun-bond or melt-blowing processes are preferred, although fabrics obtained from paper-making processes (i.e., papers such as tissue paper) can also be used. Preferably the mechanical properties of the nonwoven fabrics are similar to those of skin so that the protective collars of the present invention do not inhibit normal neck movement of the wearer. If the nonwoven fabrics are too stiff or boardy, they tend to chafe, cut or generally irritate the skin on the wearer's neck, and limit desired adhesion to the skin by a low-adherency PSA. Barrier sheets such as nonwoven fabrics having an overall flexural rigidity of up to 400 mg cm, more preferably no more than about 200 mg cm, are most suitable for use in the adherent collars of the present invention. To avoid undue difficulty in handling, the barrier sheet should usually have a flexural rigidity of 20 mg cm or more. Flexural rigidity was determined by ASTM Test Method #D-1388-64 (reapproved 1975), Cantilever Test Method wherein the "overall flexural rigidity" is defined as the square root of the product of the machine direction and cross web flexural rigidity. Nonwoven materials having basis weights of from about 25 to about 60 grams per square meter, or more preferably, nonwoven materials having basis weights of from about 35 to about 45 grams per square meter are commercially available which meet the flexural rigidity requirements described above.

A number of thermoplastic materials can be utilized to prepare the nonwoven fabrics of the collars of the present invention. Materials suitable for spun bond or melt blowing processes are especially preferred. Polyolefins, polyurethanes and polyesters are examples of suitable materials but, because most markets desiring a protective collar of the invention are very cost sensitive, less expensive nonwoven fabrics, such as low-basis-weight polyolefin webs, and more particularly polypropylene-based webs, are preferred as the nonwoven fabric.

Generally the PSA is present only as a narrow band along one edge of the fabric. The PSA should occupy the edge area of the nonwoven fabric to provide protection from particulate or fluid challenges. When the PSA band is disposed away from the edge of the collar, the portion of the fabric between the PSA band and the edge of the collar can gap or form pockets which collect particulate or fluid materials and subsequently allow them to fall down the wearer's neck.

The width of the PSA band also impacts on the handling characteristics of the collar during placement on the wearer's neck. If the band is too wide it can stick to itself as a result of incidental folding, while if it is too narrow it may require significantly longer placement time to achieve adequate positioning and adhesion. PSA bands ranging in width from about 1 cm to about 5 cm, and more preferably less than about 3 cm, have been found to offer the best balance of adhesive properties and handling performance.

A variety of PSA materials have been found to be useful in the collars of the invention. While the preferred materials are hypoallergenic in nature, a number of PSA's exhibiting low skin irritation properties have also been found to be satisfactory. Preferred PSA materials include acrylate-based medical adhesives applied in amounts to provide unusual low adherency.

Occlusive bands of PSA, e.g., continuously coated PSA materials having low moisture vapor transmission (MVT) properties, have been found to be uncomfortable, presumably because they inhibit the skin's ability to breathe and transpire moisture. However, acceptable user comfort levels can be obtained from substantially continuous coatings of PSA materials having high moisture vapor transmission (MVT) properties or from discontinuous coatings of PSA materials having a range of MVT properties, and occlusive adhesives can be used in narrow bands.

PSA materials suitable for the adhesive collars of the present invention should have a balance of adhesive properties so as to hold the collar securely to the wearer's skin, but not cause skin irritation and discomfort to the wearer when the collar is removed. Additionally, the PSA should also be able to adhere to an overlapped portion of the nonwoven fabric to secure the collar to itself, thereby providing additional support in maintaining the collar in its desired position.

Initial adhesive peel strength (i.e., the peel strength of the adhesive within about 15 seconds of application) and the adhesive build (i.e., increase of adhesion to the substrate as a function of the time the adhesive is in contact with the substrate) of the PSA on skin over a period of approximately 45 minutes are useful criteria for assessing the applicability and removability of the collars.

Characterization of the adhesive properties of a PSA toward a skin substrate requires an extensive testing program due, in part, to the variability of skin between test subjects. As a matter of convenience, adhesive properties of candidate PSA's can be screened against a more uniform substrate such as glass and then correlated back to skin adhesion properties. This latter approach, using a glass substrate, was used to screen candidate PSA materials. Corelation of this data to skin adhesion performance was accomplished through comparison of quantitative skin peel adhesion data and qualitative, user perceived comfort levels experienced on removal of nonwoven/PSA test strips from the user's neck. Based on these evaluations it was established that PSA materials having initial glass peel adhesion values of between about 5 to about 35 gm per 2.54 cm width, more preferably no more than about 25 grams per 2.54 centimeter width are most suitable for the collars of the present invention. Although such adhesion levels are very low (lower than typical medical or surgical tapes, for example), they have been found to hold a collar in place sufficiently to prevent hair cuttings to drop down the neck of a collar wearer. The PSA materials should also generally not exhibit glass adhesion peel values 45 minutes after application in excess of about 35 grams per 2.54 cm width.

In order to obtain the necessary balance of adhesion properties, the PSA is preferably applied in a manner such that it forms a discontinuous, topographically structured surface rather than a smooth continuous surface. Such a structured adhesive surface limits point contact of the PSA with itself or other substrates unless the nonwoven/PSA construction is subjected to high pressures on application to a substrate. Consequently, it is possible to bring the PSA into contact with itself and subsequently separate it without causing significant cohesive failure of the PSA or adhesive failure between the PSA and the nonwoven material. The ability to fold the collar over on itself for packaging eliminates the need for a release liner (although release liners can be used) or a low adhesion backsize coating on an adjacent collar to protect the PSA strip. Once the collar is in place on a wearer's neck, secure attachment to an overlapped portion of the nonwoven can be achieved simply by applying a higher pressure to the overlapped area of the collar.

A variety of techniques can be employed to deliver a PSA material to the nonwoven fabric in a desired discontinuous or topographically structured arrangement. Spray application is the preferred method (see European Patent Application No. 0287,557, published Aug. 3, 1988, which teaches formation of a non-repetitive pattern of adhesive islands by spray applications), but pattern coating by gravure or screen coating operations can also be used. Other methods of incorporating PSA material onto the collars of the present invention can be used, such as transfer adhesive layers on a release liner, dual-side coated PSA tape laminates, etc., but they often lack the desired balance of non-occlusiveness, handleability, skin adhesion, and adhesion to an overlapped portion of the nonwoven fabric.

The adhesive properties of the PSA strip or band can be altered over a broad range by changing variables such as the adhesive composition, adhesive coating weight, width of the adhesive band, and degree of discontinuity of the PSA material. The value of adhesiveness is generally chosen together with flexural rigidity and can for some applications (e.g., for use with very oily skins or for non-skin uses such as drapes for attachment to clothing or other surfaces) extend outside the values for initial peel adhesion to glass stated above.

The protective collars of the present invention are particularly useful in hair dressing salons, beauty shops and barber shops for applications around a wearer's neck to prevent cut hair from falling down the neck, but they also can be applied elsewhere, e.g., as barrier on the forehead to limit wetting of the face by hair treatment solutions.

FIG. 1 illustrates an adherent protective collar 10 of the present invention. The collar comprises a barrier sheet 12, which in this embodiment, is a nonwoven fabric shaped substantially as an isosceles triangle, and a PSA band 14 applied to one face of the barrier sheet along the edge 18 that constitutes the base of the triangle.

Figure 2:
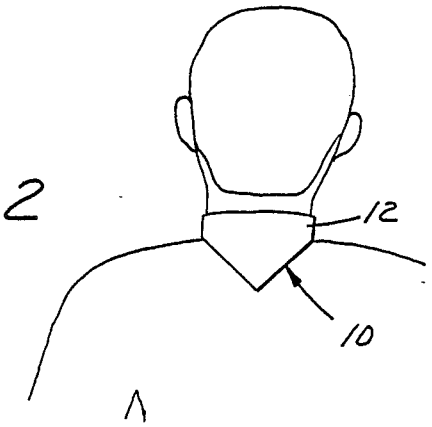
FIG. 2 is an illustration of the adherent protective collar of the present invention positioned around the neck of a wearer.

FIG. 2 is an illustration of the collar 10 affixed to a wearer's neck with an overlap of the base ends of the substantially triangularly shaped collar occuring on the front of the wearer's neck. The triangular shape of the barrier sheet 12 allows the collar 10 to conform very closely to the wearer's neck and shoulders without gapping. Alternatively, the collar may be affixed to the wearer such that the base ends of the triangularly shaped collar overlap on the back of the wearer's neck.

The barrier sheet can assume a variety of alternative shapes other than the substantially isosceles triangle shape illustrated in FIGS. 1 and 2 but the triangular shape is preferred for neck protection applications. Larger protective collars utilizing capelike shapes can also be prepared using PSA bands similar to those used on the smaller triangular shaped collars. Whatever the shape of the collar, it is desirable that the edge of the collar carrying the PSA strip be somewhat longer than the circumference of an average human neck so that the collar can be overlapped on itself to provide a total seal around the wearer's neck. Generally speaking, collars having a length of between about 50 to 75 centimeters, and more preferably a length of about 60 centimeters, have been found best for use with adults, but shorter lengths can be used for children or in other situations.

The height of the triangular shape can also vary over a fairly broad range but, practically speaking, a balance must be established between material costs and protection that the collar provides to the wearer. It has been determined that for many uses collars should be at least 10 centimeters high at the apex of the triangular shape and, more preferably, at least 20 centimeters in height.

Figure 3:
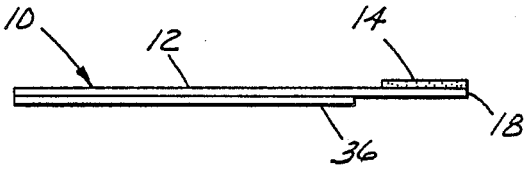
FIG. 3 illustrates an adherent protective collar of the present invention having an aqueous-fluid-impermeable hydrophobic barrier of nonwoven fabric.

FIG. 3 illustrates a second embodiment of protective collars of the present invention, which is useful for protecting a wearer against aqueous hair treatment fluids such as permanent solutions or hair coloring fluids. In this embodiment a fluid-impermeable film 36 is laminated to one face of the nonwoven fabric 12 opposite the face carrying the PSA band 14. The fluid-impermeable film 36 is generally coextensive with the nonwoven fabric except for that area immediately opposite the PSA strip 14, thereby maintaining the non-occlusive character of the collar in the area of the PSA band. The occlusive character of the PSA band may also be averted by perforating the film or overlapping only a portion of the PSA band with the film. Alternatively, and more preferably, a nonwoven fabric which has been treated with a fluorochemical or silicone material to render it impermeable to aqueous fluids (though optionally it can still be vapor transmissive) can be substituted for the film/nonwoven laminate.

Figure 4:
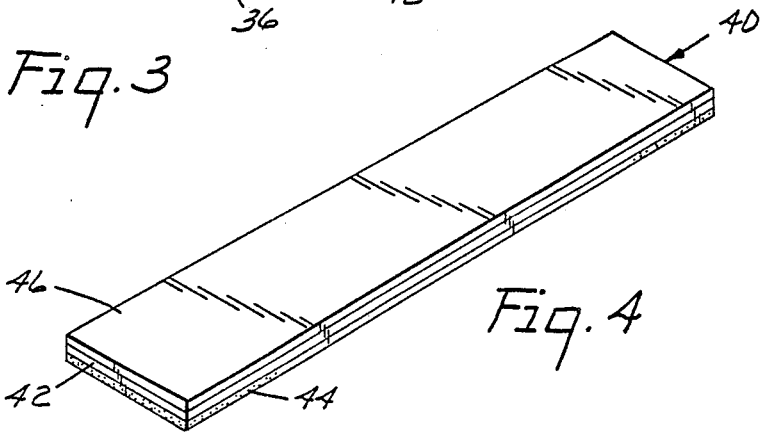
FIG. 4 illustrates an absorptive adherent protective collar of the present invention having a central aqueous-fluid-impermeable barrier layer with a hydrophilic microfibrous web capable of absorbing aqueous fluids on one face and a band of non-occlusive low-adherency pressure sensitive adhesive on its opposite face.

FIG. 4 illustrates a third embodiment of the protective collars of the present invention comprising a laminate construction 40 of an aqueous-fluid-absorbent layer 46, an aqueous-fluid-impermeable layer 42 and a PSA layer 44. The aqueous-fluid-absorbent layer can comprise a variety of hydrophilic materials such as cellulosic webs or surfactant-treated nonwoven webs based on synthetic polymers, or can comprise absorbent-containing webs such as taught in Kolpin etal, U.S. Pat. 4,429,001. The fluid-impermeable layer can be either a film/nonwoven laminate or, more preferably, a fluorochemical- or silicone-treated nonwoven material. This embodiment of the collar is particularly useful as a protective band to keep hair treatment fluids away from the wearer's skin, eyes, and clothes.

EXAMPLES

A series of PSA test strips representative of different collars of the present invention were prepared by spray-applying different coating weights of a latex emulsion of an acrylate-based PSA material to a nonwoven fabric and subsequently drying the construction in a circulating air oven. The PSA used was a 55-weight-percent solids latex in an aqueous vehicle of an adhesive similar to the 92:4:3:1 isooctyl acrylate:acrylic acid:methyl methacrylate:styrene PSA emulsion described in U.S. Pat. Re. No. 24,904, which is incorporated herein by reference. An air-atomizing spray apparatus was used to apply the PSA latex, in the dry coating weights reported in Table 1, to a nonwoven fabric. The latter was a Scott Brand #6724 thermally bonded spunbond polypropylene nonwoven web (available from Scott Paper Company, Landisville, N.J.) having a basis weight of 42 gm per square meter and an overall flexural rigidity of 35 mg cm. The thus-coated web was dried in a circulating air oven at 70° C. for about 10 seconds and cut into test strips (1.9 cm×15.2 cm).

The 180°-peel adhesive strength of the test strips to a glass substrate was determined using a I. Mass, Inc. Slip/Peel Tester (Model 3M90) available from I. Mass, Inc., Eden Prairie, Minn. Initial peel strength was determined by applying the test strips to a clean glass substrate (previously wiped with a heptane saturated swab) using a 1-kg roller, passing the roller over the test strip twice, waiting 15 seconds and pulling the strip from the glass substrate (180°) at a rate of 228.6 cm per minute. Forty-five-minute 180°-peel strength values were determined using the same procedure except that the adhered test strips were stored at room temperature for 45 minutes prior to subjecting them to the peel test. Peel strength values which are reported in Table 1 are the average of the indicated number of samples, and unlike adhesion testing on skin, showed no adhesion build over the 45 minute aging.

Quantitative skin adhesion properties were determined by applying the strips to the back of a test subject lying in a prone position, passing a 2-kg roller along the length of the test strip, once in each direction, at a speed of about 7 cm per minute. The strips were then removed from the test subject's back at 15 second and 45 minute time periods subsequent to application of the test strips, in a 180°-peel test using an adhesion tester comprising a motor driven screw with a moving carriage fitted with a transducer which determines the force required to remove the test strip at a rate of 15.2 cm per minute. Skin adhesion values, which are reported in Table 2, are the average of the indicated number of samples.

The adhesive performance and removal discomfort level on removal of the test strips from the neck of a test subject were also qualitatively examined. This evaluation, which is reported in Table 3, utilized test strips having the same adhesive coating levels as those used to obtain the quantitative data reported in Tables 1 and 2.

TABLE 1

| | 180° Peel Strength to Glass | | |
|---|---|---|---|
| Sample | Coating Weight ($gm/m^2$) | 15 Second Peel (gm/2.54 width) | Number of Samples |
| A | 2.0 | 2.5 | 7 |
| B | 4.5 | 2.8 | 14 |
| C | 9.9 | 5.9 | 13 |
| D | 34.0 | 15.8 | 16 |
| Control[1] | — | 41.5 | 6 |

[1]Micropore TM Tape, available from 3M, St. Paul, MN., 2.54 cm wide.

TABLE 2

| | 180° Peel Strength to Skin | | | |
|---|---|---|---|---|
| Sample | Coating Weight ($gm/m^2$) | 15 Second Peel (gm/2.54 width) | 45 Minute Peel (gm/2.54 width) | Number of Samples |
| A | 2.0 | 2 | 0 | 4 |
| B | 4.5 | 5 | 7 | 8 |
| C | 8.0 | 8 | 9 | 8 |
| D | 34.0 | 14 | 22 | 9 |
| Control[1] | — | 25 | 30 | 4 |

[1]Micropore TM Tape, available from 3M, St. Paul, MN., 2.54 cm width.

TABLE 3

| | Qualitative Skin Adhesion Correlations |
|---|---|
| Sample | Skin Adhesion |
| A | Poor Adhesion |
| B | Adequate holding with no discomfort on removal. Essentially no adhesion build over 45 time period. |
| C | Good holding with no discomfort on removal. Essentially no adhesion build after 45 minute time period. |
| D | Excellent holding with some discomfort on removal. Definite adhesion build over 45 minute time period. |
| Control | Excellent holding accompanied with significant discomfort on removal. |

Although the 180° peel adhesion to glass does not demonstrate an adhesion build over a 45 minute time period similar to that observed in the skin adhesion tests, peel adhesion to glass does correlate well with initial peel adhesion data observed in skin adhesion evaluations. The quantitative peel data to skin and glass coupled with the qualitative adhesion data to skin suggests that PSA strips having initial peel strengths to glass of between about 5 to 35 gm/2.54 cm do not produce excessive adhesion build on skin after 45 minutes and that PSA strips having initial peel strengths to glass of between about 10 to 25 gm/2.54 cm produce a preferred, lower, more comfortable adhesion level to skin which affords more comfortable removal after a period of 45 minutes.

What is claimed is:

1. A disposable skin-adherent protective collar comprising a soft, conformable barrier sheet and a layer of pressure-sensitive adhesive applied along at least one edge on one face of the sheet, the pressure-sensitive adhesive providing an initial peel strength to glass of between about 5 and 35 grams/2.54 centimeter width.

2. The protective collar of claim 1 wherein the layer of pressure-sensitive adhesive is discontinous.

3. The protective collar of claim 1 wherein the pressure-sensitive adhesive is applied as a narrow band between about 1 and 5.0 cm in width.

4. The protective collar of claim 2 wherein the pressure-sensitive adhesive is applied as a narrow band between about 1 and 3 cm in width.

5. The protective collar of claim 1 wherein the pressure-sensitive adhesive provides an initial peel strength to glass of up to about 25 grams/2.54 centimeter width.

6. The protective collar of claim 1 wherein the barrier sheet comprises a nonwoven fabric.

7. The protective collar of claim 2 wherein the discontinuous adhesive layer comprises a band of spray-applied adhesive.

8. The protective collar of claim 2 wherein the discontinuous adhesive layer comprises a patterned coating of adhesive.

9. The protective collar of claim 6 wherein the pressure sensitive adhesive has sufficient adhesive strength to the nonwoven fabric and the fabric has sufficient cohesive strength so that when the collar is folded over on itself with the adhesive surfaces of the folded portions in contact with one another, and subsequently separated, the adhesive will not separate from the nonwoven fabric to which it was originally applied.

10. The protective collar of claim 6 wherein the nonwoven fabric comprises a spun-bond fabric.

11. The protective collar of claim 10 wherein the spun-bond fabric comprises a polyolefin.

12. The protective collar o f claim 11 wherein said polyolefin comprises polypropylene.

13. The protective collar of claim 1 wherein the nonwoven fabric is water repellent.

14. The protective collar of claim 13 wherein said hydrophobic material is a fluorochemical material.

15. The protective collar of claim 6 wherein the nonwoven fabric has an overall flexural rigidity of up to about 400 mg cm.

16. The protective collar of claim 6 wherein the nonwoven fabric has an overall flexural rigidity of up to about 200 mg cm.

17. The protective collar of claim 1 wherein the nonwoven fabric has a substantially triangular shape having a base of between about 50 and 75 cm in length.

18. The protective collar of claim 17 wherein the substantially triangular shape is an isosceles triangle having a height of about 20 cm.

19. The protective collar of claim 18 wherein the adhesive is applied as a narrow band along the base of said isosceles triangle.

20. The protective collar of claim 1 in which the barrier sheet includes an absorbent material.

21. A disposable skin-adherent comfortably removable protective collar comprising a soft conformable barrier sheet and a discontinuous layer of pressure-sensitive adhesive applied along at least one edge on one face of the sheet, said barrier sheet having an overall flexural rigidity of up to about 200 mg cm and the adhesive having an initial peel strength to glass of up to about 25 grams/2.54 centimeter width.

22. The protective collar of claim 21 in which sheet includes an absorbent material.

23. An adhesive article comprising a soft, conformable backing having a flexural rigidity up to about 400 mg cm and a layer of pressure-sensitive adhesive applied along at least one edge on one face of the backing, the pressure-sensitive adhesive providing an initial peel strength to glass of up to about 35 grams/2.54 centimeter width.

24. The protective collar of claim 23 wherein the layer of pressure-sensitive adhesive is discontinuous.

25. The protective collar of claim 23 wherein the discontinuous adhesive layer comprises a band of spray-applied adhesive.

* * * * *

UNITED STATES PATENT AND TRADEMARK OFFICE

CERTIFICATE OF CORRECTION

PATENT NO. : 4,980,927

DATED : January 1, 1991

INVENTOR(S) : Alex A. Wawiluk; Harold J. Seppala; Arthur L. Fry

It is certified that error appears in the above-identified patent and that said Letters Patent is hereby corrected as shown below:

Col. 1, line 20, after "so", insert a period and a space.

Col. 10, line 23, after "which" insert -- the barrier --.

Signed and Sealed this

Twenty-eighth Day of July, 1992

*Attest:*

DOUGLAS B. COMER

*Attesting Officer*

*Acting Commissioner of Patents and Trademarks*